US008206240B2

(12) United States Patent
Park et al.

(10) Patent No.: US 8,206,240 B2
(45) **Date of Patent: *Jun. 26, 2012**

(54) GOLF CLUB HEAD

(75) Inventors: Sharon J. Park, Irvine, CA (US); Daniel J. Stone, Long Beach, CA (US)

(73) Assignee: SRI Sports Limited, Kobe-shi (JP)

( * ) Notice: Subject to any disclaimer, the term of this patent is extended or adjusted under 35 U.S.C. 154(b) by 46 days.

This patent is subject to a terminal disclaimer.

(21) Appl. No.: 12/838,090

(22) Filed: Jul. 16, 2010

(65) Prior Publication Data

US 2010/0279791 A1 Nov. 4, 2010

Related U.S. Application Data

(63) Continuation of application No. 11/907,903, filed on Oct. 18, 2007, now Pat. No. 7,780,549.

(51) Int. Cl.
*A63B 53/00* (2006.01)

(52) U.S. Cl. ..... 473/331

(58) Field of Classification Search ..... 473/330–331
See application file for complete search history.

(56) References Cited

U.S. PATENT DOCUMENTS

| | | | |
|---|---|---|---|
| 1,965,954 | A | 7/1934 | Davis |
| 2,520,950 | A | 9/1950 | Miller |
| 2,926,913 | A | 3/1960 | Karl |
| 4,430,416 | A | 2/1984 | Goto et al. |
| 4,529,203 | A | 7/1985 | Ribaudo |
| 4,610,581 | A | 9/1986 | Heinlein |
| 4,754,971 | A | 7/1988 | Kobayashi |
| 4,792,140 | A | 12/1988 | Yamaguchi et al. |
| 4,801,490 | A | 1/1989 | Schuette |
| 4,917,384 | A | 4/1990 | Caiati |
| 5,127,675 | A | 7/1992 | Moss |
| 5,190,289 | A | 3/1993 | Nagai et al. |
| 5,358,249 | A | 10/1994 | Mendralla |
| 5,437,088 | A | 8/1995 | Igarashi |
| 5,472,201 | A | 12/1995 | Aizawa et al. |
| 5,484,155 | A | 1/1996 | Yamawaki et al. |
| 5,601,501 | A | 2/1997 | Kobayashi |
| 5,611,742 | A | 3/1997 | Kobayashi |
| 5,665,013 | A | 9/1997 | Kobayashi |

(Continued)

FOREIGN PATENT DOCUMENTS

| | | |
|---|---|---|
| JP | A-73-006522 | 1/1973 |

(Continued)

OTHER PUBLICATIONS http://thesandtrap.com/clubs/vokey_spin_milled_wedge_review (Jul. 12, 2005).

(Continued)

*Primary Examiner* — Gene Kim
*Assistant Examiner* — Matthew B Stanczak
(74) *Attorney, Agent, or Firm* — Oliff & Berridge, PLC

(57) ABSTRACT

A golf club head comprising a strike face having a heel portion, a toe portion, and an intermediate portion. The intermediate portion includes one or more score lines. At least a portion of one or more score lines include a different average surface roughness and associated surface reflectance than at least the intermediate portion. A method for producing such a club head is also provided.

11 Claims, 7 Drawing Sheets

U.S. PATENT DOCUMENTS

| | | | | |
|---|---|---|---|---|
| 5,674,132 | A | 10/1997 | Fisher | |
| 5,676,605 | A | 10/1997 | Kobayashi | |
| 5,688,186 | A | 11/1997 | Michales et al. | |
| 5,735,755 | A | 4/1998 | Kobayashi | |
| 5,804,272 | A | 9/1998 | Schrader | |
| 5,958,170 | A | 9/1999 | Cetrangolo | |
| 6,187,849 | B1 | 2/2001 | Nugent et al. | |
| 6,193,614 | B1 | 2/2001 | Sasamoto et al. | |
| 6,346,052 | B1 * | 2/2002 | Chappell | 473/324 |
| 6,402,636 | B1 | 6/2002 | Chang | |
| 6,402,637 | B1 | 6/2002 | Sasamoto et al. | |
| 6,475,099 | B1 | 11/2002 | Sumitomo et al. | |
| 6,713,717 | B2 | 3/2004 | Takeda | |
| 6,719,644 | B2 | 4/2004 | Beach | |
| 6,916,253 | B2 | 7/2005 | Takeda | |
| 6,945,307 | B2 | 9/2005 | Tsai | |
| 6,981,923 | B2 | 1/2006 | Chappell | |
| 7,040,000 | B2 | 5/2006 | Takeda | |
| 7,080,560 | B2 | 7/2006 | Takizawa et al. | |
| 7,258,627 | B2 | 8/2007 | Chappell | |
| 7,568,983 | B2 * | 8/2009 | Gilbert | 473/330 |
| 7,780,549 | B2 | 8/2010 | Park et al. | |
| 2003/0032498 | A1 | 2/2003 | Erb et al. | |
| 2004/0127300 | A1 | 7/2004 | Roesgen et al. | |
| 2004/0192465 | A1 | 9/2004 | Erb et al. | |
| 2005/0130761 | A1 | 6/2005 | Vokey et al. | |
| 2006/0025233 | A1 | 2/2006 | Lin | |
| 2007/0010346 | A1 | 1/2007 | Gilbert et al. | |
| 2007/0149312 | A1 | 6/2007 | Gilbert | |
| 2008/0076594 | A1 | 3/2008 | Liu et al. | |
| 2008/0132351 | A1 * | 6/2008 | Ban et al. | 473/331 |

FOREIGN PATENT DOCUMENTS

| | | |
|---|---|---|
| JP | A-02-234777 | 9/1990 |
| JP | A-10-248974 | 9/1998 |
| JP | A-10-277185 | 10/1998 |
| JP | A-2003-190335 | 7/2003 |
| JP | A-2003-293198 | 10/2003 |
| JP | A-2004-277811 | 10/2004 |
| JP | A-2007-325859 | 12/2007 |

OTHER PUBLICATIONS

Jul. 24, 2008 Office Action issued in U.S. Appl. No. 11/643,666.
Feb. 23, 2009 Office Action issued in U.S. Appl. No. 11/643,666.
Jul. 10, 2009 Office Action issued in U.S. Appl. No. 11/643,666.
Oct. 22, 2009 Notice of Allowance issued in U.S. Appl. No, 11/643,666.
Sep. 21, 2009 Office Action issued in U.S. Appl. No. 11/907,903.
Dec. 28, 2009 Office Action issued in U.S. Appl. No. 11/907,903.
Jul. 16, 2010 Notice of Allowance issued in U.S. Appl. No. 11/907,903.
Jun. 24, 2011 Office Action issued in U.S. Appl. No. 12/627,568.
Nov. 28, 2011 Office Action issued in U.S. Appl. No. 12/627,568.

* cited by examiner

GOLF CLUB HEAD

This is a Continuation of application Ser. No. 11/907,903, filed Oct. 18, 2007. The entire disclosure of the prior application is hereby incorporated by reference herein in its entirety.

BACKGROUND

In conventional iron-type club heads, score lines in the strike face are generally used to improve the trajectory of a golf shot. Foreign matter, e.g., sand, water, and organic material, typically introduced into the score lines at ball impact, adversely affects shot accuracy. Ordinarily, score lines receive a roughening treatment during the manufacturing process, which increases their propensity for retaining foreign matter. Since the accumulation of foreign matter decreases the functionality of the score lines, the golfer is required to frequently clean the score lines to maintain their effectiveness. Lack of frequent cleaning of the score lines not only may have an adverse effect on club performance, but also may contribute to the excessive wear of the score lines.

Moreover, the roughening treatment generally produces score lines having a dull, lusterless appearance, making the score lines appear smaller. Since smaller score lines are associated with decreased spin at ball impact, the dull appearance of the score lines may reduce player confidence in the equipment.

SUMMARY OF THE INVENTION

The present invention, in one or more aspects thereof, may advantageously comprise a golf club with score lines that deliver improved spin characteristics, are easier to clean, and elevate the golfer's confidence in his or her equipment.

In one example, a golf club head according to one or more aspects of the present invention may comprise a strike face including a heel portion, a toe portion, and an intermediate portion between the heel portion and the toe portion. The intermediate portion may include one or more score lines thereon. At least one of the score lines or a portion thereof and at least a region of at least one of the heel portion and the toe portion may have a first surface roughness. At least a region of the intermediate portion may have a second surface roughness that is different from the first surface roughness.

In another example, a golf club head according to one or more aspects of the present invention may comprise a strike face including a heel portion, a toe portion, and an intermediate portion between the heel portion and the toe portion. The intermediate portion may include one or more score lines thereon. At least one of the score lines or a portion thereof and at least a region of at least one of the heel portion and the toe portion may have a first surface reflectance. At least a region of the intermediate portion may have a second surface reflectance that is different from the first surface reflectance.

In another example, a golf club head according to one or more aspects of the present invention may comprise a strike face including a heel portion, a toe portion, and an intermediate portion between the heel portion and the toe portion. The intermediate portion may include one or more score lines thereon. At least a region of at least one of the heel portion and the toe portion may have a first surface reflectance, the intermediate portion may have a second surface reflectance, and at least a portion of one or more score lines may comprise a third surface reflectance. The first surface reflectance may be greater than the third surface reflectance and the third surface reflectance may be greater than the second surface reflectance. The heel portion and/or the toe portion, the intermediate portion, and the score lines may have a first, a second, and a third outer coating, respectively. Preferably, the first, the second, and the third outer coatings are the same coating.

In one example, a method of producing a golf club head according to one or more aspects of the present invention may comprise providing a golf club head with a striking face comprising a heel portion, a toe portion, and an intermediate portion, wherein the intermediate portion may have a surface reflectance and a plurality of score lines; placing a masking material into at least a portion of one or more score lines; changing the reflectance of the intermediate portion devoid of the masking material; and removing the masking material from the score lines.

In another example, a method of producing a golf club head according to one or more aspects of the present invention may comprise providing a golf club with a striking face comprising a heel portion, a toe portion, and an intermediate portion, wherein the intermediate portion may have a surface reflectance and a plurality of score lines; depositing a first coating on at least a portion of the club head; placing a masking material into at least a portion of one or more score lines; changing the reflectance of the intermediate portion devoid of the masking material; removing the masking material from the score lines; and depositing a second coating on at least a portion of the club head.

In another example, a golf club head according to one or more aspects of the present invention may comprise a heel portion, a toe portion, and an intermediate portion between the heel portion and the toe portion. The intermediate portion may have a first outer coating and a first surface reflectance. One or more score lines, having a second outer coating and a second surface reflectance, may lie within the intermediate portion. Preferably, the first and the second outer coatings are the same coating. The club head may further include an alignment mark comprising the first surface reflectance and the second surface reflectance.

These and other features and advantages of the golf club head according to the invention in its various aspects as illustrated by one or more of the following examples, will become apparent after consideration of the ensuing description, the accompanying drawings, and the appended claims. The accompanying drawings are provided for illustrative purposes only and are not intended to limit the scope of the present invention.

BRIEF DESCRIPTION OF THE DRAWINGS

Exemplary implementations of one or more aspects of the present invention will now be described with reference to the accompanying drawings, wherein.

DETAILED DESCRIPTION

Figure 1:
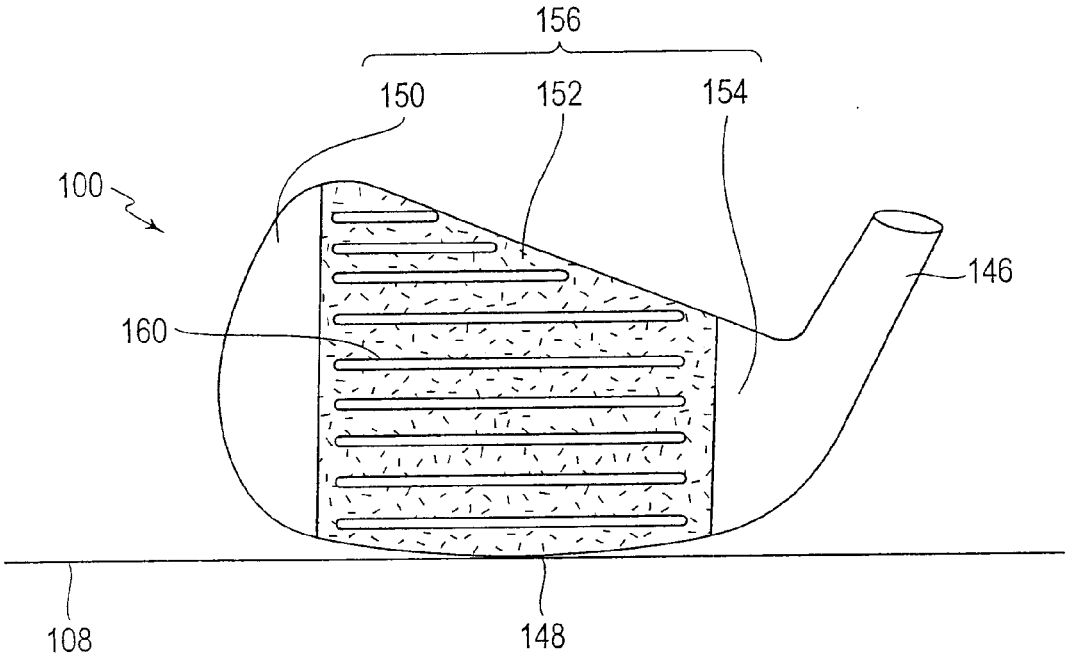
FIG. 1 is a front elevational view of an exemplary golf club head according to one or more aspects of the present invention.

As shown in FIG. 1, a golf club head 100 in accordance with one or more aspects of the present invention may include a strike face 156, a sole 148, a rear portion (not shown), and a hosel 146. The strike face 156 may include a toe portion 150, a heel portion 154, and an intermediate portion 152 between the heel portion 154 and the toe portion 150. The intermediate portion 152 may include one or more score lines 160.

The intermediate portion 152 may further comprise an average surface roughness having an associated reflectance. Generally, the intermediate portion 152 may receive a roughening treatment, e.g., media blasting or a chemical etch, to reduce its surface reflectance and create a matte finish. Preferably, the average surface roughness is between about 20 μin and about 200 μin, more preferably between about 40 μin and about 200 μin, and most preferably between about 60 μin and about 200 μin.

At least a portion of one or more score lines may comprise a lower average surface roughness than the average surface roughness of the intermediate portion 152. Preferably, the average surface roughness of at least a portion of one or more score lines 160 is between about 5 μin and about 120 μin, more preferably between about 5 μin and about 50 μin, and most preferably between about 5 μin and about 30 μin. Accordingly, at least a portion of one or more score lines 160 will have a reflectance greater than that of the intermediate portion 152 and therefore may appear shiny to the golfer. The shiny quality may cause the score lines 160 or portions thereof to appear larger. Since larger score lines are generally synonymous with improved spin characteristics, the shiny appearance of the score lines 160 or portions thereof will improve player confidence in the equipment, leading to consistent shots. Furthermore, the lower average surface roughness of the score lines 160 reduces the amount of debris that accumulate in the score lines, thus promoting more consistent ball spin throughout a golf round.

Referring again to FIG. 1, the average surface roughness of at least a portion of one or more score lines 160 may be substantially the same as the average surface roughness of the heel portion 154 and/or the toe portion 150. Preferably, the average surface roughness of the heel portion and/or the toe portion is between about 5 μin and about 120 μin, more preferably between about 5 μin and about 50 μin, and most preferably between about 5 μin and about 30 μin. In one example, the average surface roughness of the score lines 160, the heel portion 154, and the toe portion 150 may be decreased to produce an aesthetically pleasing "mirror" finish having a correspondingly greater reflectance. The matte finish of the intermediate portion 152 may have a lower reflectance relative to that of the score lines 160, the heel portion 154, and the toe portion 150.

In another example according to one or more aspects of the invention, the average surface roughness and the associated reflectance of a portion of one or more score lines 160, the intermediate portion 152, and at least one of the heel portion 154 and the toe portion 150 may be different. Preferably, the average surface roughness of the intermediate portion 152 may be greater than the average surface roughness of at least a portion of one or more score lines 160 and the average surface roughness of at least a portion of one or more score lines 160 may be greater than that of the heel portion 154 and/or the toe portion 150.

Figure 1A:
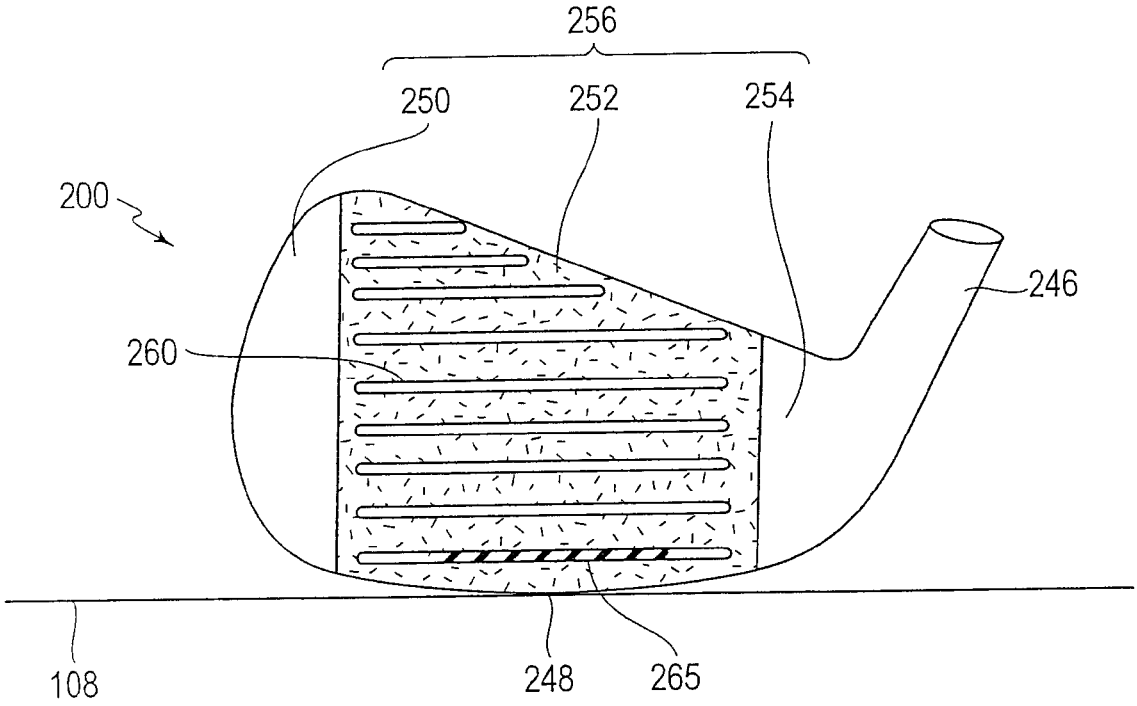
FIG. 1A is a front elevational view of another exemplary golf club head according to one or more aspects of the present invention.

With reference to FIG. 1A, at least a portion of one or more score lines 260 in accordance with one or more aspects of the present invention may include a filler material 265, e.g., paint. The filler material 265 may comprise any color, which may promote improved aesthetics of the golf club head 200. Generally, the filler material 265 may be located in the score line closest to the sole 248 to assist the golfer in properly aligning the club head 200 with the ball at address.

Figure 1B:
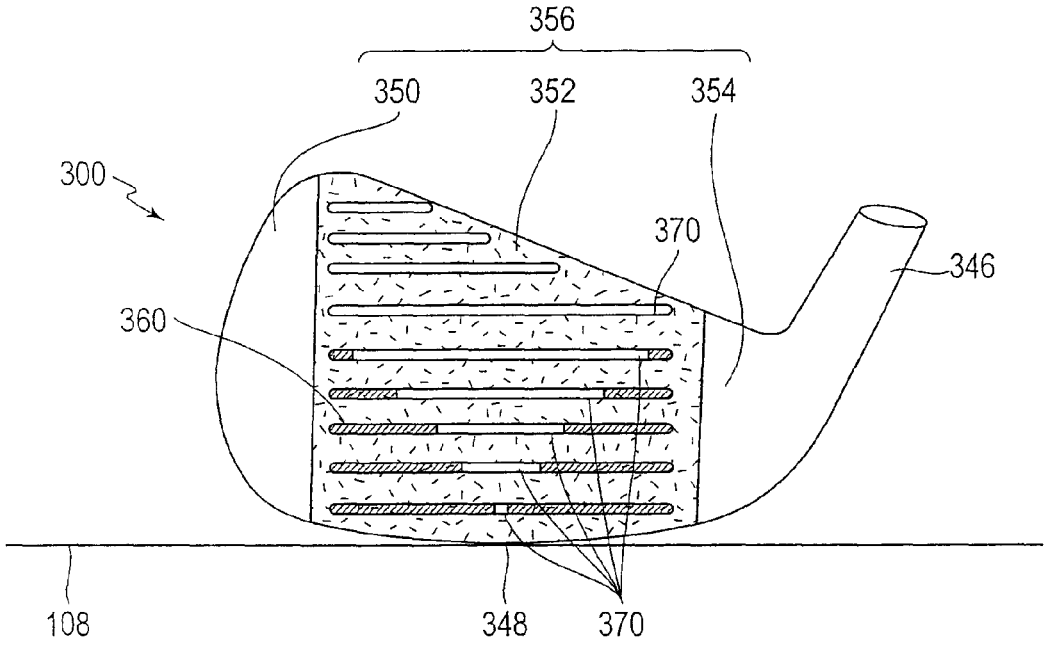
FIG. 1B is a front elevational view of yet another exemplary golf club head according to one or more aspects of the present invention.

With reference to FIG. 1B, a golf club head 300 in accordance with one or more aspects of the present invention may include a strike face 356 having a toe portion 350, a heel portion 354, and an intermediate portion 352 between the heel portion 354 and the toe portion 350. The intermediate portion 352 may include one or more score lines 360.

Referring again to FIG. 1B, the intermediate portion 352, comprising a first average surface roughness, and at least a portion of one or more score lines 360, comprising a second average surface roughness, may constitute an advantageous alignment feature 370 on the strike face 356. The alignment feature 370 may help the golfer to properly address the golf club head and to align the club head with the ball at address, thus improving accuracy and distance. Although the alignment feature 370 may have the general appearance of a triangle, other alignment indicia, e.g., circular alignment markings, rectangular alignment markings, trapezoidal alignment markings, irregular or any other suitably shaped alignment markings, are contemplated to be within the scope of the present invention in one or more aspects thereof.

Figure 2A:
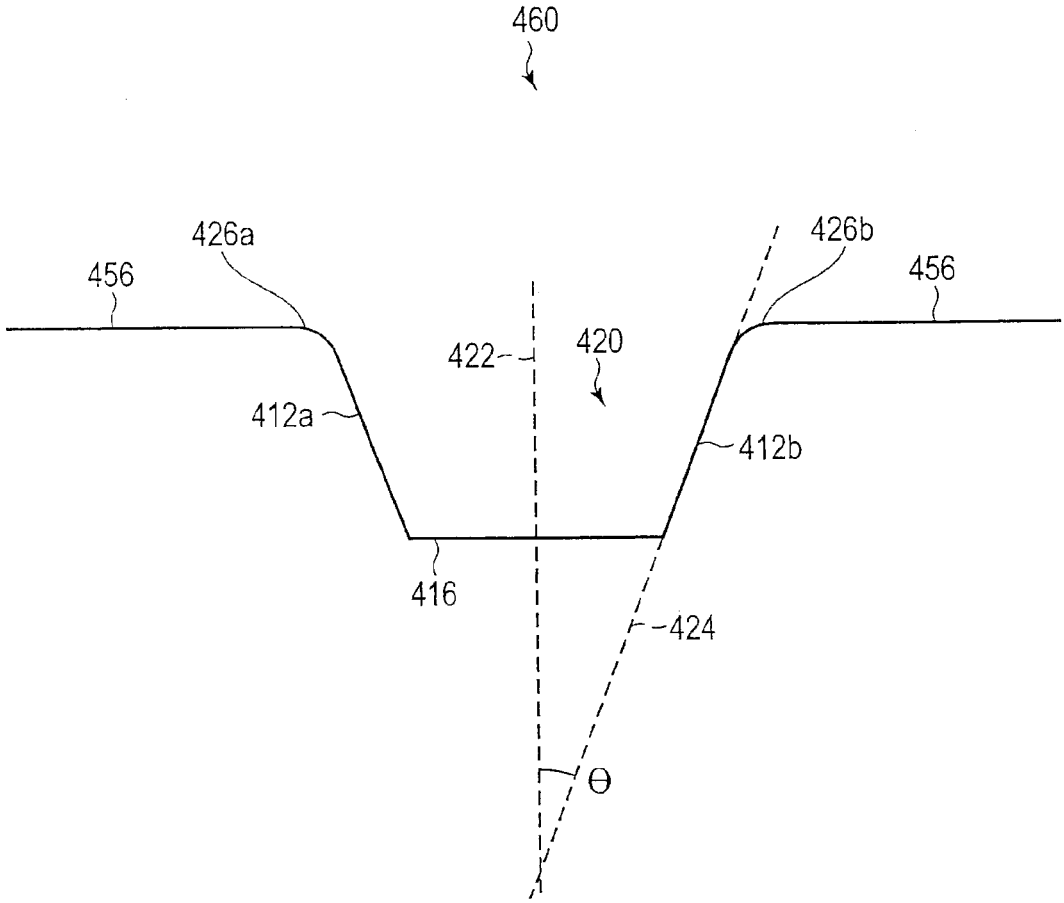
FIG. 2A is a cross-sectional view of a score line of an exemplary golf club head according to one or more aspects of the present invention.

With reference to FIG. 2A, one or more score lines, e.g., the score line 460, may include a trough 420, defined by a first side wall 412*a*, a second side wall 412*b*, and a bottom wall 416 disposed between the first side wall 412*a* and the second side wall 412*b*. A pair of curved shoulders 426*a* and 426*b* may connect the side walls 412*a* and 412*b* to the strike face 456. The score line 460 may further comprise at least one draft angle formed between an imaginary first line 422 that is substantially perpendicular to the strike face 456, and an imaginary second line 424 substantially parallel to one of the side walls 412*a* and 412*b* and lying in the plane of the drawing paper of FIG. 2A. Preferably, the draft angle θ is less than about 10°. More preferably, the draft angle θ is less than about 5°.

Figure 2B:
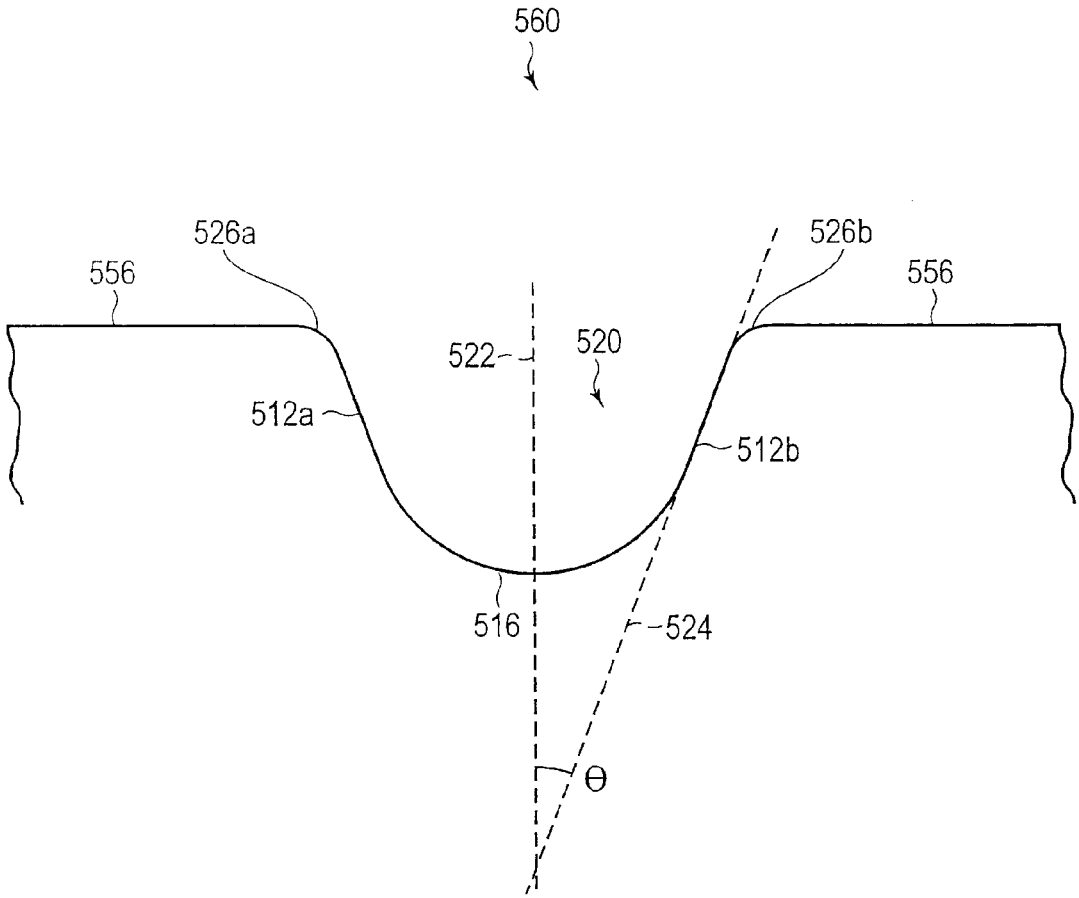
FIG. 2B is a cross-sectional view of a score line of another exemplary golf club head according to one or more aspects of the present invention.

Although the score line 460 is depicted as having a V-shaped cross-section, other score line cross-sectional shapes are possible. For example, referring to FIG. 2B, each score line, e.g., the score line 560, may comprise a U-shaped cross-section. The score line 560 may include a trough 520, delimited by a first side wall 512*a*, a second side wall 512*b*, and a curved bottom wall 516 disposed between the first side wall 512*a* and the second side wall 512*b*. A pair of shoulders, e.g., the curved shoulders 526*a* and 526*b* may connect the side walls 512*a* and 512*b* to the strike face 556. The score line 560 may further comprise at least one draft angle formed between an imaginary first line 522 substantially perpendicular to the strike face 556, and an imaginary second line substantially parallel to one of the side walls 512*a* and 512*b* and lying in the plane of the drawing paper of FIG. 2B. Preferably, the draft angle θ is less than about 10°. More preferably the draft angle θ is less than about 5°.

Figure 2C:
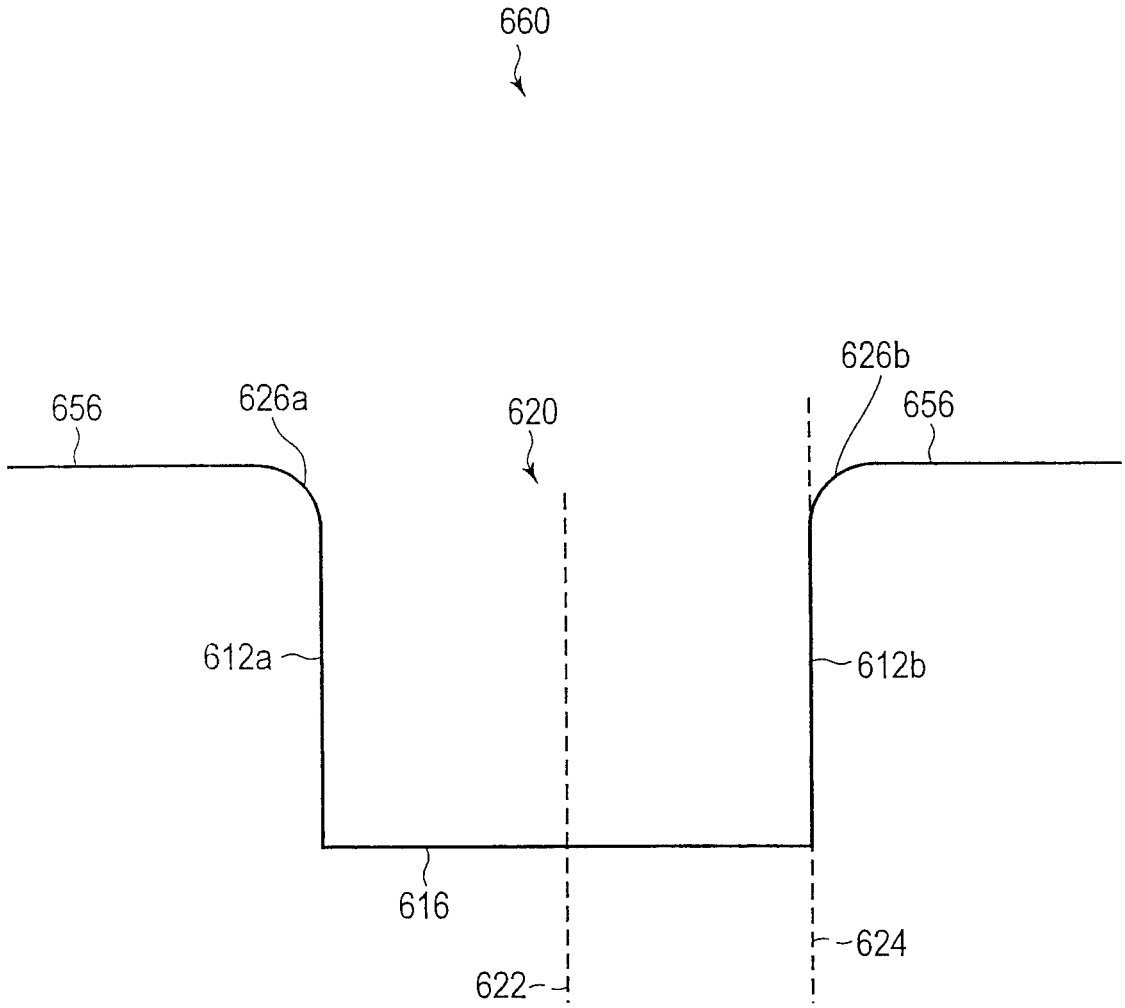
FIG. 2C is a cross-sectional view of a score line of yet another exemplary golf club head according to one or more aspects of the present invention.

With reference to FIG. 2C, each score line, e.g., the score line 660, may further have a box-shaped cross-section. The score line 660 may include a trough 620 defined by a first side wall 612*a*, a second side wall 612*b*, and a bottom wall 616 disposed between the first side wall 612*a* and the second side wall 612*b*. A pair of curved shoulders 626*a* and 626*b* may connect the side walls 612*a* and 612*b* to the strike face 656. The score line 660 may further comprise a draft angle (not shown), formed between an imaginary first line 622, substantially perpendicular to the strike face 656, and an imaginary second line 624, substantially parallel to one of the side walls 612*a* and 612*b* and lying in the plane of the drawing paper of FIG. 2C, of substantially 0°.

Figure 3:
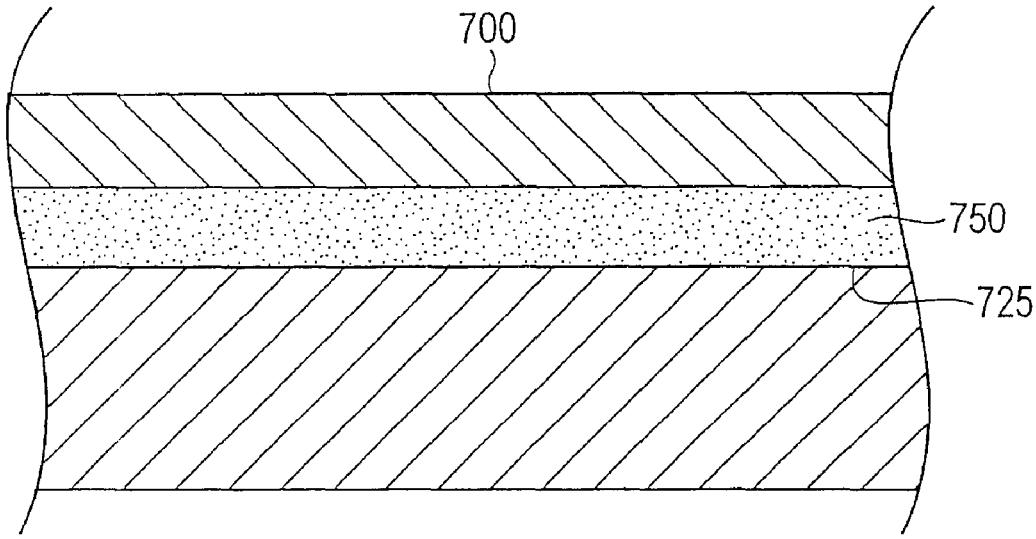
FIG. 3 is a cross-sectional view of the golf club head of another exemplary golf club head according to one or more aspects of the present invention

To produce a club head having one or more of the above described features, one of a plurality of methodologies may be utilized. Referring again to FIG. 1, a club head according to one or more aspects of the present invention, e.g., the club head 100, may be formed from a metallic material, e.g., 17-4 stainless steel, titanium, or the like, by a forging or casting process. After the initial forming step is completed, the strike face may be machined flat, the club head may be polished, and one or more score lines, e.g., the score lines 160, may be introduced into the strike face by, e.g., a CNC milling machine. As shown in FIG. 3, an undercoating 750, e.g., nickel plating, may then be deposited on the exterior 725 of the formed club head. The undercoating may serve as a base layer for a decorative outer coating 700, e.g., chromium, which is applied to the club head at a later stage in the manufacturing process.

To achieve a lower average surface roughness than the intermediate portion, e.g., the intermediate portion 152, at least a portion of one or more score lines may be protected with a masking material, e.g., a wax or a polymeric filler material, prior to receiving a roughening treatment described below. In one example, the masking material may be heated to its melting temperature and deposited within at least a portion of one or more score lines. Once the masking material has solidified, the roughening treatment may be applied to the intermediate portion by at least one of: a mechanical, a chemical, or a mechanical-chemical process. Following the roughening treatment, the masking material may be removed by heating the masking material to its melting temperature and disposing of the liquefied material. The heel portion, e.g., the heel portion 154, and/or the toe portion, e.g., the toe portion 150, may also be protected from the roughening treatment, e.g., by masking tape.

The decorative outer coating may then be deposited on at least a portion of the club head. Hence, the outer coating of one or more score lines, the intermediate portion, the heel portion, and the toe portion of the club head may be the same. In addition to improving the aesthetics, the decorative outer coating may provide corrosion and wear resistance to the club head.

Although the operations of the method(s) herein are shown and described in a particular order, the order of the operations of each method may be altered so that certain operations may be performed in an inverse order or so that certain operation may be performed, at least in part, concurrently with other operations. In another example, instructions or sub-operations of distinct operations may be in an intermittent and/or alternating manner.

In the foregoing specification, the invention has been described with reference to specific exemplary embodiments thereof. It will, however, be evident that various modifications and changes may be made thereto without departing from the broader spirit and scope of the invention as set forth in the appended claims. The specification and drawings are, accordingly, to be regarded in an illustrative rather than a restrictive sense.

The invention claimed is:

1. An iron-type golf club head comprising a strike face and a sole, the strike face comprising:

a heel portion and a toe portion, wherein at least one of the heel portion and the toe portion comprises a first average surface roughness;

an intermediate portion between the heel portion and the toe portion, the intermediate portion comprising a second average surface roughness; and a plurality of score lines in the intermediate portion, at least a portion of at least one of the plurality of score lines comprising a third average surface roughness between about 5 μin and about 30 μin, wherein the third average surface roughness is less than the second average surface roughness, the first average surface roughness is between about 5 μin and about 120 μin, the first average surface roughness is less than the second average surface roughness, and the third average surface roughness is less than the first average surface roughness.

2. The iron-type golf club head of claim 1, wherein the second average surface roughness is between about 20 μin and about 200 μin.

3. The iron-type golf club head of claim 1, wherein the golf club head is formed from a metallic material and further comprises a nickel undercoating applied to the metallic material.

4. The iron-type golf club head of claim 3, wherein the golf club head further comprises a chromium outer coating applied to the nickel undercoating.

5. An iron-type golf club head comprising a strike face and a sole, the strike face comprising:

a heel portion and a toe portion, wherein at least one of the heel portion and the toe portion comprises a first surface reflectance and a first average surface roughness;

an intermediate portion between the heel portion and the toe portion, the intermediate portion comprising a second surface reflectance and a second average surface roughness; and a plurality of score lines in the intermediate portion, at least a portion of at least one of the plurality of score lines comprising a third surface reflectance and a third average surface roughness between about 5 μin and about 30 μin, wherein the third surface reflectance is greater than the first surface reflectance and the second surface reflectance, and the third average surface roughness is less than the first average surface roughness and the second average surface roughness.

6. The iron-type golf club head of claim 5, wherein the second average surface roughness is between about 20 μin and about 200 μin.

7. The iron-type golf club head of claim 6, wherein the second average surface roughness is between about 40 μin and about 200 μin.

8. The iron-type golf club head of claim 5, wherein the first average surface roughness is between about 5 μin and about 120 μin.

9. The iron-type golf club head of claim 8, wherein the first surface reflectance is greater than the second surface reflectance.

10. The iron-type golf club head of claim 9, wherein the golf club head is formed from a metallic material and further comprises a nickel undercoating applied to the metallic material.

11. The iron-type golf club head of claim 10, wherein the golf club head further comprises a chromium outer coating applied to the nickel undercoating.

* * * * *